US006309493B1

(12) United States Patent
Braun et al.

(10) Patent No.: US 6,309,493 B1
(45) Date of Patent: Oct. 30, 2001

(54) METHOD FOR FILLING CRACKS IN A CONCRETE STRUCTURE WITH FOAMABLE POLYURETHANE PREPOLYMER

(75) Inventors: Robert Braun, New Lenox; Diana Dobrez-Florez, Crest Hill; Jess Garcia, Warrenville; Deborah Schutter, Minooka, all of IL (US)

(73) Assignee: Flexible Products Company, Marietta, GA (US)

( * ) Notice: Subject to any disclaimer, the term of this patent is extended or adjusted under 35 U.S.C. 154(b) by 0 days.

(21) Appl. No.: 09/248,670

(22) Filed: Feb. 11, 1999

(51) Int. Cl.[7] ..... B29C 65/52; B29C 73/02; B29C 73/10; B29C 73/12

(52) U.S. Cl. ..... 156/94; 156/247; 156/344; 264/31; 264/34; 264/36.2; 264/36.22; 264/238; 52/742.13; 52/742.16; 72/409.19; 72/416

(58) Field of Search ..... 264/36.2, 31, 34, 264/36, 22, 238, 46.6; 52/742.16, 742.13; 72/370.12, 409.19, 416; 156/94, 247, 344

(56) References Cited

U.S. PATENT DOCUMENTS

| | | | | |
|---|---|---|---|---|
| 1,883,196 | * | 10/1932 | Wertz | 264/36.2 |
| 1,953,452 | * | 4/1934 | Wertz | 264/36.2 |
| 2,313,110 | * | 3/1943 | Wertz | 264/36.2 |
| 3,236,005 | * | 2/1966 | Tomosy et al. | 72/416 |
| 3,593,799 | * | 7/1971 | Boughton et al. | 264/36.2 |
| 3,826,680 | | 7/1974 | Rio et al. . | |
| 3,847,722 | | 11/1974 | Kistner . | |
| 3,917,771 | * | 11/1975 | Basile | 264/36.2 |
| 4,240,995 | * | 12/1980 | Milne | 264/36.2 |
| 4,360,994 | * | 11/1982 | Hodges | 264/36.2 |
| 4,414,347 | | 11/1983 | Reich et al. . | |
| 4,555,286 | * | 11/1985 | Orikasa et al. | 264/36.2 |
| 4,555,295 | * | 11/1985 | Orikasa et al. | 264/36.2 |
| 4,703,089 | | 10/1987 | Damico . | |
| 4,758,295 | | 7/1988 | Sawaide et al. . | |
| 4,855,001 | | 8/1989 | Damico et al. . | |
| 4,861,401 | * | 8/1989 | Miura et al. | 264/36.2 |
| 4,930,281 | * | 6/1990 | Martin et al. | 264/36.2 |
| 4,986,862 | * | 1/1991 | Matsufuru | 264/36.2 |
| 5,000,890 | * | 3/1991 | DiStefano et al. | 264/36.2 |
| 5,063,006 | * | 11/1991 | Tahara | 264/36.2 |
| 5,096,962 | | 3/1992 | Holmes-Farlet et al. . | |
| 5,155,965 | * | 10/1992 | Tabei et al. | 156/94 |
| 5,186,949 | * | 2/1993 | Lai | 264/36.2 |
| 5,253,957 | * | 10/1993 | Fujikawa | 264/36.2 |
| 5,732,530 | * | 3/1998 | Pfaff | 72/416 |

OTHER PUBLICATIONS

Avanti International Technical Information Sheets AV–510, AV–530 & AV 540—Fall 1995.
SPECCO Industries Data Sheets for U–Mix Urethane Injection Resins 1:1, 40:1, W–10 Waterstopper Cemnet & 301 HVM Mercapton Epoxy gel Oct. 1995.
Polygem "Liquid Concrete Repair" Mixing and application Directions 1995.
Lily Corporation, "Bill of Wares", 1997.
Flexible Products Company, "Insta–Seal" brochure 1997.

* cited by examiner

*Primary Examiner*—Jan H. Silbaugh
*Assistant Examiner*—Michael I. Poe
(74) *Attorney, Agent, or Firm*—Vedder Price Kaufman & Kammholz

(57) ABSTRACT

A method for filling cracks in concrete surfaces using a one-component, hydrophilic polyurethane prepolymer without the addition of any granular impregnating agents The prepolymer is provided in a hand-held aerosol container and is injected into the cracks through hollow injection ports that are adhered in place on the surfaces over the cracks and subsequently closed off when filled. The crack is filled from the bottom up to prevent the formation of air pockets in the crack.

12 Claims, 5 Drawing Sheets

METHOD FOR FILLING CRACKS IN A CONCRETE STRUCTURE WITH FOAMABLE POLYURETHANE PREPOLYMER

BACKGROUND OF THE INVENTION

The present invention relates generally to systems for filling cracks in foundation walls, and more particularly, to a method of filling such cracks with an aerosol liquid and to a system for use with such a method.

Many methods of construction are not perfect. Homeowners that purchase newly built or older homes may discover cracks in the foundation walls of their homes. These cracks may be large in size, up to one-half inch in width or they may be small in size, up to three-sixteenths inch in width. Cracks in any foundation walls, no matter what the size of the crack, can unfortunately teak and admit water into the basement of the house, possibly damaging furnishings and finished areas of the basement. There are many compounds available in the marketplace for sealing such foundation cracks. Some of these compounds include two-component reactive epoxies, hydraulic cements or grouts and plastic-based fillers that are troweled into the crack.

It is also generally known to use polyurethane-based foams to seal such cracks. U.S. Pat. No. 3,847,722 that issued Nov. 12, 1974 describes a crack sealing apparatus and method utilizing a deformable and permeable substrate that is impregnated with a hydrophilic urethane prepolymer for filling cracks and preventing water from leaking through the crack. This substrate includes a complex web element that is formed from an expanded vermiculite. The web element must be impregnated with a separately provided urethane prepolymer by the user, by pouring it onto the web to saturate it entirely with the prepolymer. Once the web element is saturated, the web element is folded or rolled up and wedged or pushed into the crack. When the impregnated material contacts water passing through the crack, the prepolymer expands to form a water-insoluble polyurethane gel. The use of this urethane prepolymer in liquid form by the user is not only messy, but also the user must store the prepolymer in a moisture-proof container to avoid exposure to moisture and start the activation and curing of the prepolymer.

Another similarly complicated method of fixing cracks is described in U.S. Pat. No. 4,758,295, issued Jul. 19, 1988. This patent describes a method of sealing leaks in cracks of concrete walls using a moisture-cured polyurethane prepolymer that has a separate impregnating agent added to it in the form of a granular agent, such as cement or grout. Adding such an agent to a prepolymer is expensive. It may also likely affect the dispensing and injection characteristics of the prepolymer leading to application difficulties and necessitating the use of a high-pressure injection system that is beyond the expense and ability of an ordinary consumer and homeowner.

Neither of these two patents provide a user-friendly system for filling cracks that is simple to use by a homeowner and disposable. Accordingly, the present invention is directed to a method for filling cracks with a liquid hydrophilic urethane prepolymer utilizing a prepressurized aerosol delivery of the prepolymer into the crack and a kit of parts for utilizing such a method that is easily utilized by a consumer to fill cracks without any technical expertise.

SUMMARY OF THE INVENTION

It is therefore a general object of the present invention to provide a concrete crack filling system for use by consumers that is user-friendly and disposable.

It is another object of the present invention to an improved method for filling cracks in concrete by injecting a urethane prepolymer into a crack from a pressurized supply container utilizing an injection tube that enters the mouth of the crack, the injection tube and supply container being disposable.

It is a further object of the present invention to provide a method for filling cracks in concrete or stone walls that includes the steps of: cleaning out loose debris from the crack; applying one or more injection ports to the concrete or stone wall to provide one or more entryways into the crack; covering the exterior of the crack with a sealant material to enclose the crack and the injection ports; providing an amount of crack filling compound in the form of a moisture curable, one-component polyurethane prepolymer in a disposable, aerosol-pressurized container; providing a disposable dispensing nozzle for the aerosol container; injecting the prepolymer into the crack by way of the injection ports and letting the prepolymer cure and seal the crack.

Another object of the present invention is to provide a kit of parts for sealing cracks, the kit including a disposable pressurized container of one-component urethane prepolymer, a dispensing nozzle and injection tube that are attachable to the supply container, a plurality of injection ports and an epoxy compound for sealing the injection parts to the crack.

Yet still another object of the present invention is to provide a method for reliably filling cracks in a concrete or stone wall that includes the steps of: cleaning the crack to remove base debris; attaching a plurality of injection ports over the crack and in communication with the crack, the injection ports being spaced a predetermined distance apart from each other; sealing the outer surface of the crack to create a continuous internal cavity within the crack; testing the sealed crack for continuity; providing a disposable pressurized container containing a one-component urethane prepolymer that expands upon exit from the container and contact with water; methodically injecting, in a stepwise fashion, the prepolymer into the crack from the bottom up through one injection port at a time, permitting the injected prepolymer to flow into the crack to the level of the next injection port, capping off the lower injection port and injecting the prepolymer at the next injection port above the capped injection port.

These and other objects, features and advantages of the present invention will be clearly understood through consideration of the following detailed description.

DETAILED DESCRIPTION OF THE PREFERRED EMBODIMENTS

Figure 1:
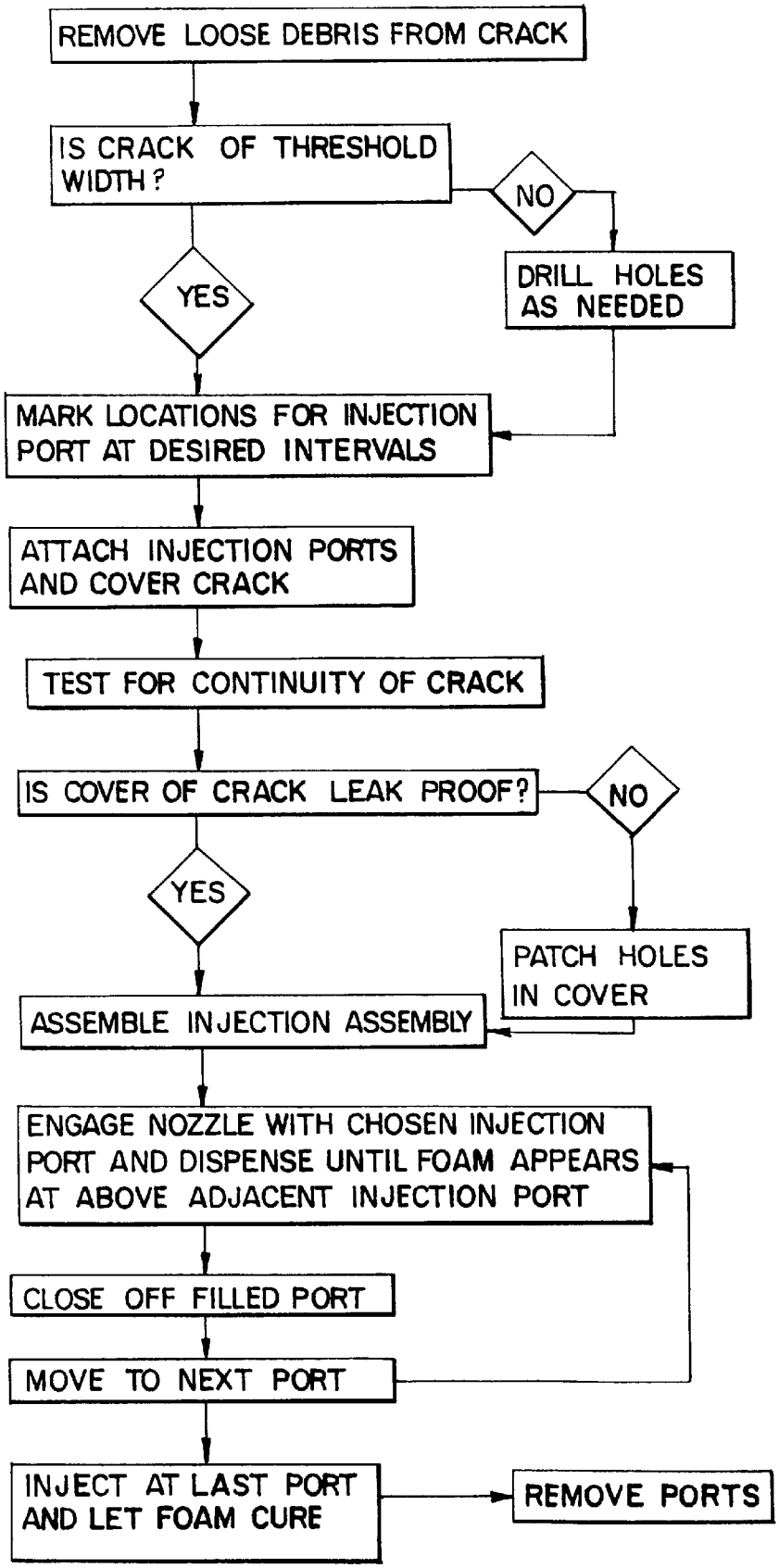
FIG. 1 is a process flow chart, illustrating schematically, the steps employed in the methods of the present invention.
Figure 2:
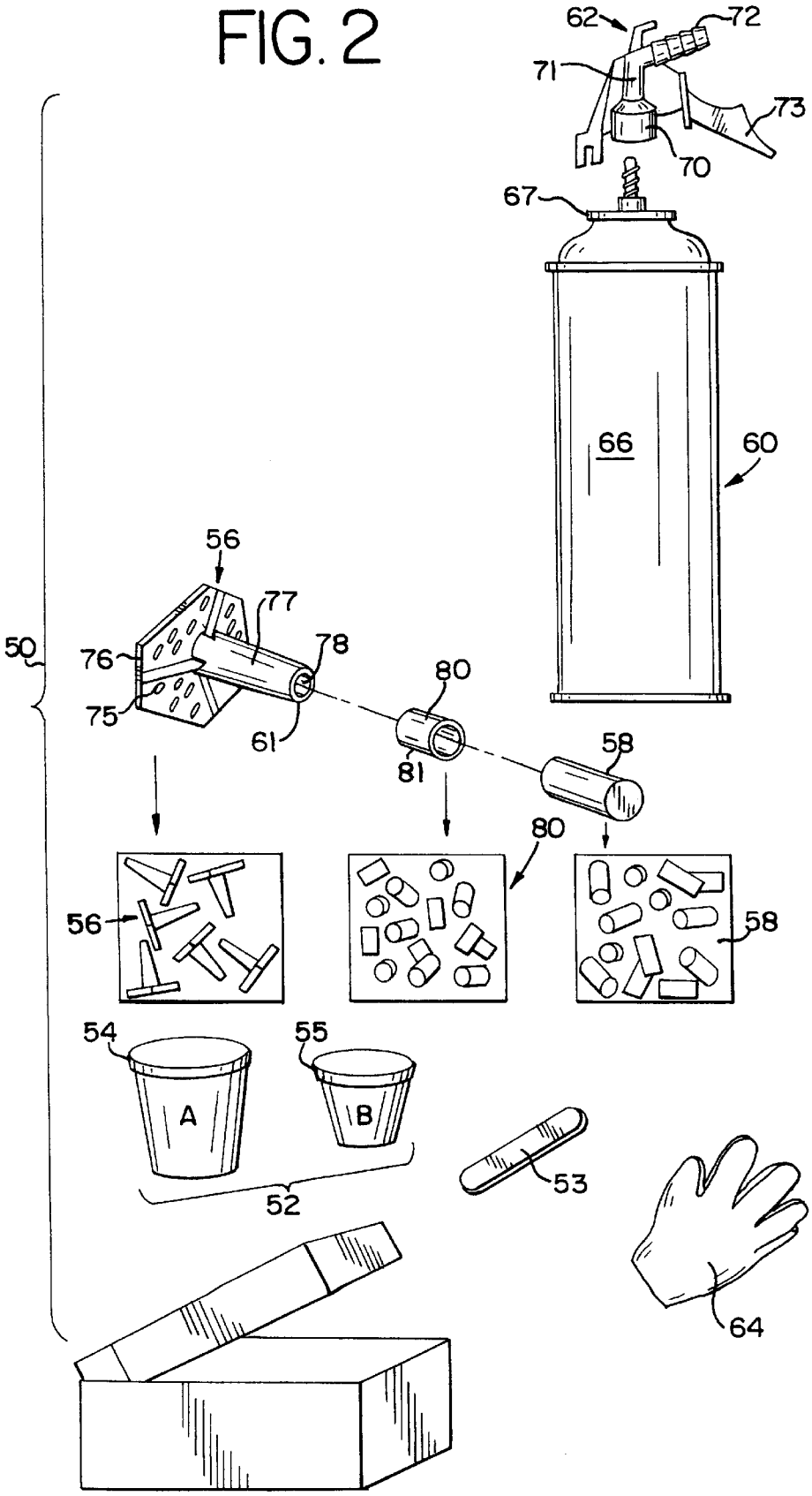
FIG. 2 is perspective view of a kit of parts used in the methods of the present invention.

The present invention is directed to a method of filling cracks in solid, poured concrete and/or stone walls using a kit of parts 50 that are easily utilized by a homeowner. Such a kit 50 is illustrated in FIG. 2. The kit 50 preferably contains a settable adhesive exterior covering compound 52, shown as a two-part epoxy compound utilizing respective, separate amounts of A and B reactive components 54, 55 with a spatula 53 for mixing the components together, a plurality of crack injection ports 56, a plurality of caps 58 that fit over the ends of the injection ports 56, a series of crimps 80 that fit on the injection ports 56, a pressurized container 60 with a supply of an aerosol-driven, one-component prepolymer, and a dispenser assembly 62 that fits the supply container 60 and that mates with the injection ports 56. A set of disposable gloves 64 may also be provided for the user in the kit 50.

Figure 9:
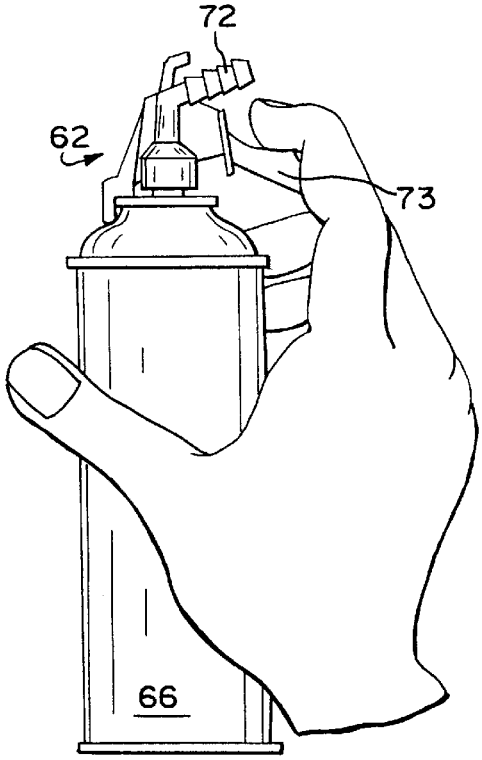
FIG. 9 is a view illustrating the step of assembling the foam injection assembly.

The supply container 60 preferably takes the form of disposable aerosol can 66 as shown in FIG. having a valve assembly 67 formed in one end 68 thereof by which the crack-filling compound exits from the container 60 when the valve assembly 67 is actuated. The dispenser assembly 62 illustrated can be seen to have a hollow base portion 70 that engages the valve assembly 67 of the aerosol can 66 and a body portion 71 that is interposed between the base portion 70 and an elongated nozzle 72. An actuator lever 73 is joined to the body portion 71 and extends out from the central axis of the supply container 60 at an angle therefrom so that a user may contact it with one or more fingers while holding the container 60. (FIG. 9.)

Figure 2A:
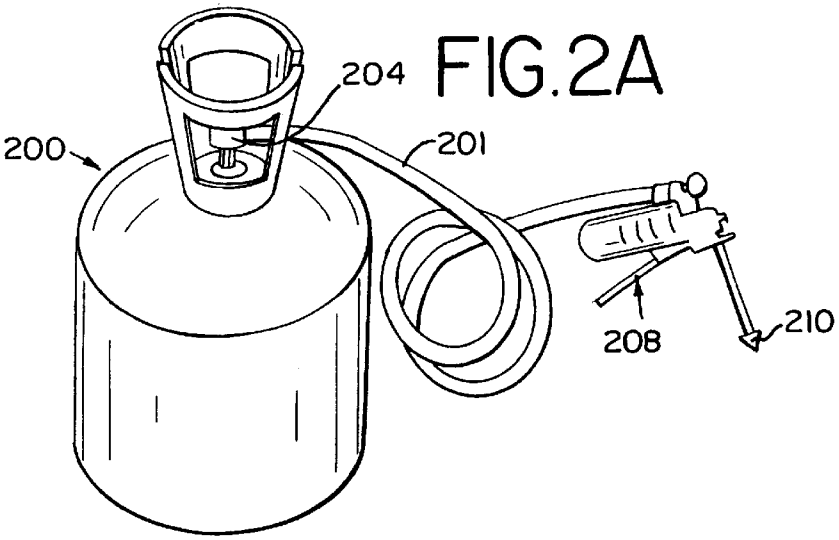
FIG. 2A illustrates some alternate components that suitable for use in the kit of parts of FIG. 2.

Alternatively, as illustrated in FIG. 2A, the disposable container may take the form of a larger container 200, commonly referred to in the art as a "180" container that is filled with approximately 30 pounds of sealing material. This container is also known by its DOT designation as a DOT-39 NRC 260/325 container. This container is disposable in the sense that it is manufactured as a thin-walled container that cannot be refilled under federal law. The container 200 has associated therewith, a delivery hose 201, a valve assembly 204 and a hand-operated dispensing gun 208 through which the contents of the container may be discharged. The gun 208 preferably has a tip that mates with the body portions 77 of the injection ports 56. Such a gun is commonly sold by the assignee of the present invention under the trade names "Pro-Gun" or "Great-Gun" and are used to dispense one-component polyurethane prepolymers. The structure of such guns are described in US Pat. Nos. 5.615,804 and 5,549,228, the disclosures of which are herein incorporated by reference.

As further shown in FIG. 2, the kit 50 includes a plurality of injection ports 56 that have flat, perforated base portions 76 for attachment to the surfaces surrounding the crack 90. The perforations 75 in the base portions 76 of the ports 56 permit the adhesive 52 to securely mount them to and over the crack 90. The injection ports 56 further include a tubular, hollow body portion 77 that is open at both ends thereof. This body portion 77 defines a hollow injection passage 78 through the ports 56 into the crack.

Figure 11:
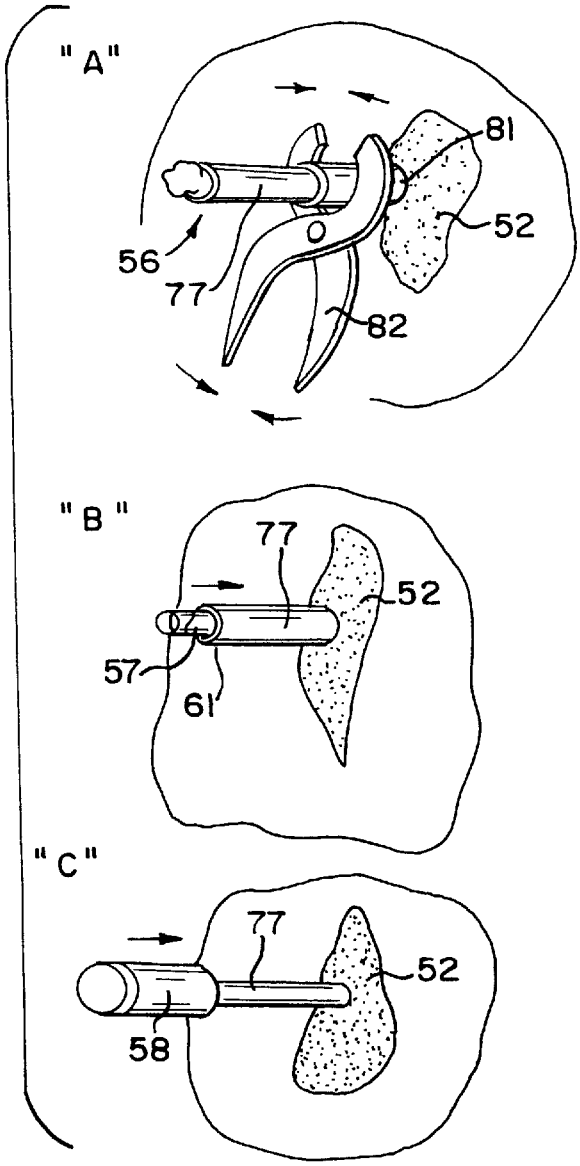
FIG. 11 is a view illustrating the step of closing off the injection port with different closure elements to prevent backflow of the crack-filling prepolymer out of the port.

A series of closure elements, such as crimps 80 may be supplied with the kit 50 that may be applied to the body portions 77 of the injection ports 56 in order to constrict the size of the passage in the injection port body portion 77 or to close off the passage altogether. These crimps 80 preferably take the form of hollow metal collars 81 that are sized to fit onto and over the injection port body portions 77. When squeezed by a pliers 82 or other tool as shown in detail "A" of FIG. 11, the crimps 80 deform and serve to pinch the injection port body portions 77 closed or to at least partially collapse them to prevent the flow of prepolymer back out of the injection port 56. The kit 50 may further include a set of caps 58 (shown in detail "C" of FIG. 11), in place of the crimps 80, that fit over the free ends of the injection ports 56 for sealing the free ends 61 of the ports 56. As shown in detail "B" of FIG. 11, plugs 59 that are insertable into the open ends 61 of the injection ports may also accompany the kit in lieu of the crimps 80 or caps 58.

As stated previously, the kit 50 includes a hand-held, pressurized supply container 60 that contains a predetermined amount of an injectable crack filling compound. This compound is preferably a one-component polyurethane prepolymer that is moisture-cured, i.e., hydrophilic in nature, and which is easily dispensed under aerosol pressure and which expands and foams when dispensed from its supply container 60 and when it contacts moisture. The composition of this compound includes a polyester polyol, an isocyanate, a catalyst such as a B–B'dimorpholinodiethylether and a plasticizer such as a mixture of dibutyrate ester isomer. When the isocyanate is reacted with the aforementioned polyol, a polyurethane liquid with an affinity for water is created. The crack filling compound has an excess amount of isocyanate to make it hydrophilic. A propellant is provided in the supply container 60 that drives the compound out of the container 60 and assists in partly forming the foamed end product. A charge of nitrogen having a pressure of about 125 psi is used as the propellant in order to drive the prepolymer out of the supply container and into the crack as explained in greater detail below.

Importantly, unlike the aforementioned prior art, the crack filling compound does not include a granular material as a crack impregnating agent, such as a water-reactive cement or grout. With the use of such a material, as taught by U.S. Pat. No. 4,758,295, care must be taken by the applicator to ensure the proper ratio of materials so as not to affect the curing characteristics thereof. Additionally, because the present invention does not utilize any additional granular component or additive such as cement or grout, the crack filling prepolymer of the present invention is more inexpensively made and may be easily dispersed from an aerosol container, such as the hand-sized can 66 depicted.

Figure 3:
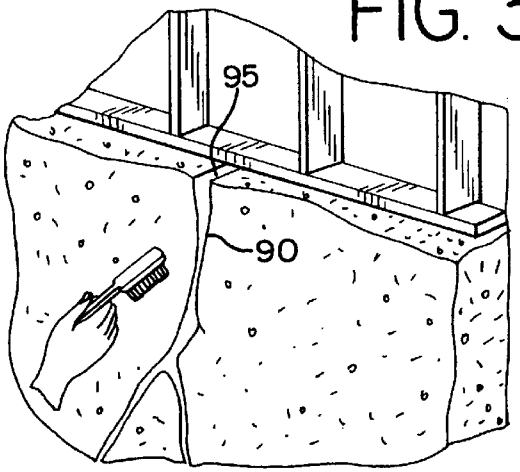
FIG. 3 is a view illustrating the step of cleaning out a crack in a concrete or stone wall.
Figure 5:
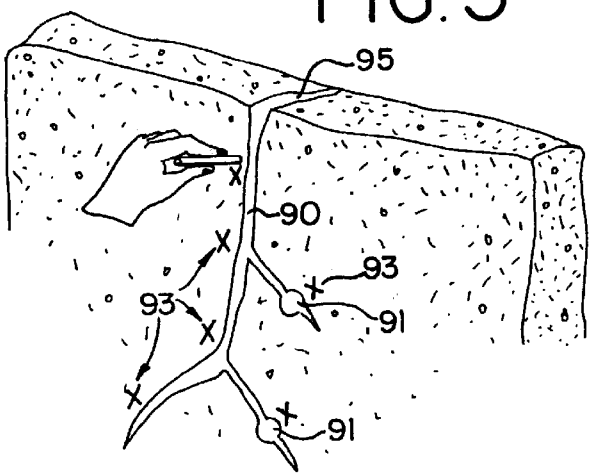
FIG. 5 is a view illustrating the step of marking injection port locations at a desired spacing along the crack.
Figure 4:
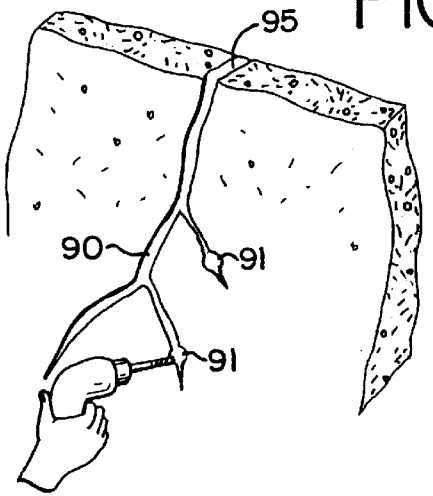
FIG. 4 is a view illustrating the step of drilling an injection opening in the crack.

The implementation the methods of the present invention shall now be discussed. The preliminary step in this inventive method is illustrated in FIG. 3 and involves cleaning of the crack 90 by using a brush or compressed air or other similar means in order to remove loose debris, dirt and from the crack 90. The size of the crack 90 is first determined, and if the crack is less than one-quarter to one-eighth inch in width, injection holes 91 are drilled into the surface 92 and crack 90 at intervals of about 8 to 10 inches beginning at the base of the crack 90 and ending beneath the top of the crack, preferably about 5 to 6 inches below the top. (FIG. 4.) Where the width of the crack 90 is greater than one-eighth to one-fourth inches, injection port registration marks 93 are placed at intervals of about 10 to 12 inches. (FIG. 5.)

Figure 6:
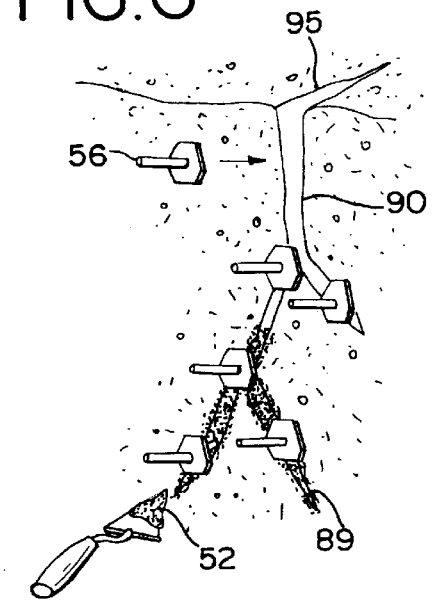
FIG. 6 is a view illustrating the step of attaching the injection ports to the crack and sealing the crack around the injection ports to provide an exterior cover for the crack.

A series of injection ports 56 are then applied to the crack 90 at the marked intervals and in alignment with the injection holes 91. These ports 56 are applied to the crack by first mixing the adhesive components 54, 55 supplied in the kit 50 and applying it to the edges of the crack 90. The injection ports 56 have the mixed epoxy 52 applied to them using the spatula 52, or a trowel, so that the port base portions 76 are firmly embedded in it and excess epoxy flows through the perforations 75 in the port base portions 76. (FIG. 6). Once all of the injection ports 56 are attached, the remaining epoxy 52 is used to form a cover 89 extending over the crack 90 in order to completely cover the crack 90 and the base 76 of each port 56.

Once the epoxy has cured, typically about 24 hours, the crack 90 is tested for continuity by injecting a bubble-forming compound, such as a soapy water solution 92, into each of the ports 56. Air is applied to the bottom port of the crack 90 and the other ports are examined to determine the formation of bubbles 91 at the other ports 56. If bubbles form at the other ports, it indicates that there is continuity between all of the ports through the length of the crack 90.

Figure 7:
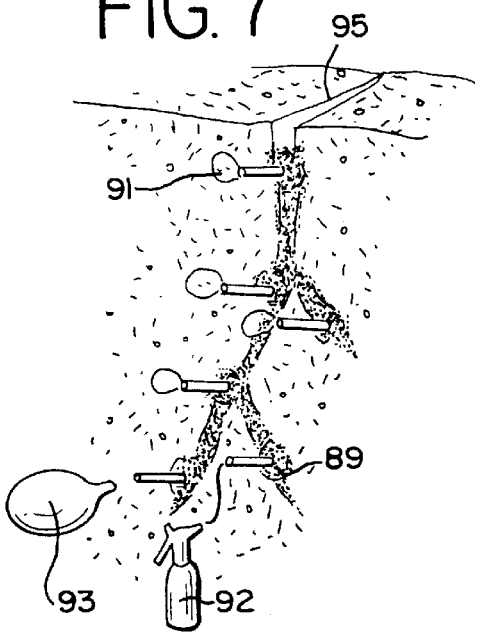
FIG. 7 is a view illustrating the step of testing the injection ports and the covered crack for continuity.
Figure 8:
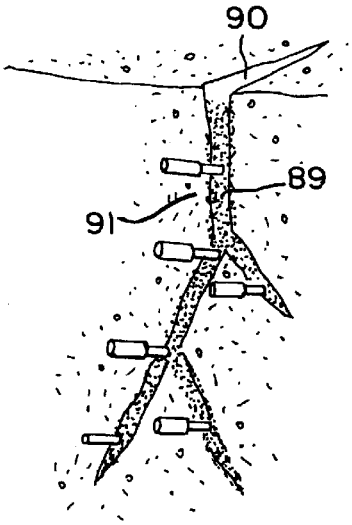
FIG. 8 is a view illustrating the step of testing the sealed crack for leaks.

The crack 90 and its epoxy cover 89 is then tested for leaks by placing caps 50 over all of the injection ports 56 except one, preferably the bottom port. Soapy water 92 is again preferably sprayed into the open injection port and then air is injected into the open port 56 via a suitable means, such as the squeeze bottle 94 illustrated in FIG. 7. The epoxy cover 89 is then examined for bubbles 91 that would indicate leaks in it. Any such leaks that are found may then be sealed with a fast-set epoxy.

Figure 10:
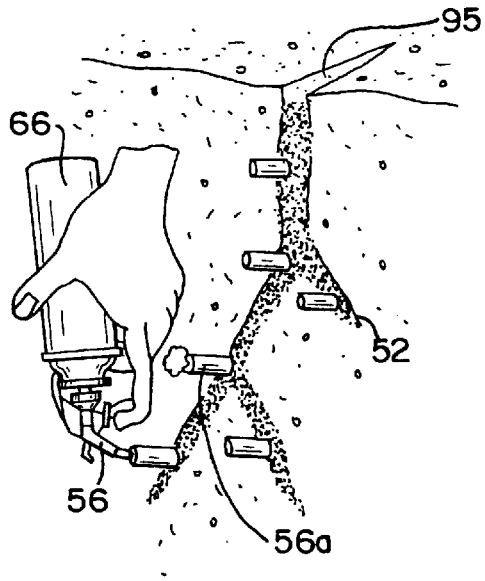
FIG. 10 is a view illustrating the step of injecting the crack-filling prepolymer into the crack in a stepwise fashion.

The foam dispenser is then assembled by engaging the dispenser assembly 62 to the valve assembly 67 of the supply container 60. (FIG. 9.) The dispenser nozzle 72 is then mated to the bottom injection port 56 after inverting the can 60 by inserting the tip thereof in to the injection port body portion 77 and the dispenser actuator lever 72 is depressed by the user in order to open the valve assembly 67. (FIG. 10.) The prepolymer then exits the container 60 and flows through the bottom port 56 into the crack 90 up to the next injection port 56*a* located above it. A crimp 80 (FIG. 11, detail "A") is then crimped to the port body portion 77 in order to seal the lower port. Alternatively, the dispenser is then removed and a cap 58 or plug 57 (details "B" and "C" of FIG. 11), may then be applied to the end of the port. The dispenser is then moved to the next highest port and the process repeated until foam is injected into the topmost injection port and appears at the top 95 of the crack.

The polyurethane prepolymer is injected from the bottom up along the crack 90 because it is desirable to have the foaming material push itself up through the crack in order to avoid the formation of air pockets. As the prepolymer meets and reacts with water in the crack 90, it forces air in the crack upward and out of the crack at the top 95 of the concrete wall.

Figure 13:
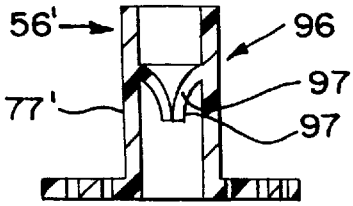
FIG. 13 is a cross-sectional view of an alternative injection port that may be used with the present invention.

Alternatively as shown in FIG. 13, injection ports 56' having check or one-way valves 96 incorporated therein may be used to provide a connecting passage between the dispenser and the crack. The valve 96 of the port 56' will eliminate the need for the applicator to apply either a crimp 80 or a plug 58 to the port 56'. Such a valve 96 may include a diaphragm, or skirt member 97 that is located within the injection port body portion 77'.

Figure 12:
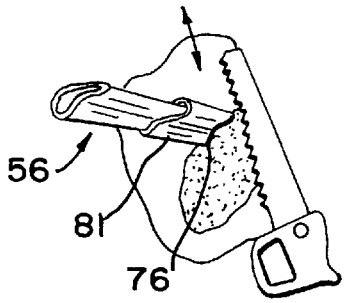
FIG. 12 is a view illustrating the step of removing the injection ports once the crack-filling compound has cured.

After the injection process is completed, the prepolymer is allowed to cure which will take about 7 to 10 days. It should be noted that the injecting of soapy water into the crack is beneficial in that it provides moisture that promotes the foaming of the prepolymer into an expandable foam. Standing water in the crack will also serve the same purpose. The water injection may also be easily accomplished via a conventional squeeze bottle 94. If, however, for any reason, no water is injected into the crack prior to injecting the prepolymer, the prepolymer will draw moisture out of the concrete and from the atmosphere for curing. Once the polyurethane foam has cured, the injection ports 56 may then be sawn off near their base portions 76. (FIG. 12.)

It will be appreciated that the present invention has a novel disposable nature in that all of its components may be discarded by the user after use. The prepolymer has no impregnating agent and comes in a pressurized supply container that is ready to use by a homeowner without the need for mixing or utilizing a separate dispensing system. The dispensing nozzle easily mates with the injection ports which also simplifies the implementation of the method so that a homeowner of average skill may use it to effectively seal cracks. Additionally, the polyurethane prepolymer is adhesive in nature so that it will adhere to the opposing surface of the crack and remain in place within the crack. It has a desirable viscosity that facilitates its injection into the crack, and it has a desirable flexibility that permits the cured foam to slightly expand and contract within the crack under various climatic conditions.

While the preferred embodiments of the invention have been shown and described, it will be apparent to those skilled in the art that changes and modifications may be made therein without departing from the spirit of the invention, the scope of which is defined by the appended claims.

What is claimed is:

1. A method of filling in a crack in a surface of a concrete structure, comprising of steps of:

(a) providing a plurality of injection port members for application to said crack, the injection port members having flat base portions and tubular body portions, the tubular body portions defining hollow passages that extend through said injection port members, said members having free, open ends opposite their base portions;

(b) applying said injection port members to said concrete structure surface at predetermined intervals along said crack such that said injection port member hollow passages are aligned with and directed toward said crack, and adhering said injection ports to said concrete structure surface with a settable adhesive;

(c) covering the remainder of said crack with said settable adhesive while leaving an opening at a top portion of said crack and letting said settable adhesive set to define a sealed, inner passage extending through said crack in communication with said injection port hollow passages;

(d) providing a supply of an injectable crack-filling material in the form of a hydrophilic one-component polyurethane prepolymer that expands and foams in response to contact with water said prepolymer not containing any granular impregnating agent entrained within it, said prepolymer supply including a disposable, aerosol supply container having dimensions such that it may be easily held and grasped in a single hand of a user, said supply container further having a dispenser assembly attached thereto with a dispensing nozzle extending therefrom, the dispensing nozzle having a tip that is engageble with said injection port members by way of said dispensing nozzle tip fitting into said injection port member free ends into communication with said injection port member hollow passages;

(e) dispensing said prepolymer into said crack in a stepwise fashion from top to bottom along said crack by first engaging said prepolymer supply container dispensing nozzle tip with the lowermost injection port member hollow passage and dispensing said prepolymer into said crack through said lowermost injection port member hollow passage until said prepolymer appears at an injection port member located immediately above said lowermost injection port member;

(f) closing off said lowermost injection port member by applying a deformable crimping collar to said lowermost injection port member body portion prior to engaging said, lowermost injection port member body portion with said dispensing nozzle and removing said dispensing nozzle tip from said lowermost injection port member and then applying pressure to said crimping collar sufficient to substantially collapse said lowermost injection port member hollow passage; and, (g) repeat steps (e) and (f) for subsequent injection port members positioned above said lowermost injection port member.

2. The method of claim 1, further including a step of cleaning out loose debris from said crack prior to injecting said prepolymer therein.

3. The method of claim 1, further including a step of injecting water into said crack prior to injecting said prepolymer therein to promote foaming and expansion of said prepolymer.

4. The method of claim 1, wherein said dispenser assembly has an actuating lever that when depressed, opens said dispensing nozzle so that said prepolymer will flow out of said supply container and through said dispensing nozzle, the actuating lever extending away from said dispensing assembly at an angle that permits actuation thereof by said user's hand holding said supply container.

5. A method of filling a crack in a concrete wall so as to top leakage of water through the crack, the method comprising: providing predetermined supply of a one-component, hydrophilic polyurethane prepolymer in a pressurized, disposable container; cleaning said crack to remove loose debris therefrom; determining the size of said crack; forming a series of openings in said crack if said crack does not exceed a threshold size; providing a series of injection ports having flat base portions with hollow, tubular body portions projecting therefrom; installing said injection ports onto a surface surrounding said crack in alignment with and over said crack; applying an adhesive compound to areas of said crack at predetermined intervals along the length of said crack; applying said injection ports to said surface surrounding said crack in a manner such that said injection port tubular body portions open into said crack; covering said crack with the adhesive compound to create a sealed, interior passage within said crack that extends the length of said crack; applying a dispensing nozzle to said supply container; engaging said dispensing nozzle to an open end of the lowermost injection port; actuating said nozzle to dispense said prepolymer into said lowermost injection port and into said crack until said prepolymer appears at a second injection port disposed above said lowermost injection port; closing the lowermost injection port to prevent backflow of prepolymer out of said lowermost injection port; removing said dispensing nozzle from engagement with said lowermost injection port and engaging said second injection port with said dispensing nozzle; actuating said dispensing nozzle to inject an amount of prepolymer through said second injection port and into said crack until said prepolymer appears at a third injection port disposed above said second injection port; closing off said second injection port to prevent backflow of said prepolymer through said second injection port and subsequently removing said dispensing nozzle from said second injection port; and, engaging subsequent, higher injection ports with said dispensing nozzle and injecting said prepolymer therein until said prepolymer enters said crack and appears at injection ports above the level of the injection port at which said injection is occurring; and, closing off said injection ports by providing deformable metal sleeve crimping collars, by applying said crimping collars to said injection port body portions prior to injecting said prepolymer into said injection ports, and by deforming said crimping collars to substantially collapse said injection port body portions.

6. The method according to claim 1, further including steps of testing for leaks in said adhesive compound after it has been applied over said crack, and sealing any leaks found in said adhesive compound.

7. The method according to claim 5, further including a step of allowing said prepolymer to cure within said crack and subsequently removing said injection ports from said surface surrounding said crack.

8. The method according to claim 7 wherein said dispensing nozzle includes a dispensing gun having a free nozzle end dimensioned to fit within said injection port free ends.

9. The method according to claim 5, wherein said prepolymer supply container has a size that permits it to be held in one hand by a user.

10. The method according to claim 9, wherein said dispensing nozzle has a nozzle free end that extends away from said prepolymer supply container and said dispensing nozzle further includes an actuating level extending away from a central axis of said prepolymer supply container and positioned for actuating by one hand of said user.

11. The method to claim 1, further including a step of checking continuity of said sealed interior passage formed in said crack by spraying a liquid into said injection ports hollow passages, injecting air into said crack at one of said injection ports and checking for appearance of said liquid at the remaining injection ports.

12. The method according to claim 11, wherein said liquid promotes foaming and expansion of said prepolymer.

* * * * *